United States Patent [19]

Vogel et al.

[11] 4,193,781

[45] Mar. 18, 1980

[54] HEAD PRESSURE CONTROL FOR HEAT RECLAIM REFRIGERATION SYSTEMS

[75] Inventors: Kenneth E. Vogel, Mound; Jerome D. Powlas, Minneapolis, both of Minn.

[73] Assignee: McQuay-Perfex Inc., Minneapolis, Minn.

[21] Appl. No.: 900,992

[22] Filed: Apr. 28, 1978

[51] Int. Cl.[2] ..... F25B 41/00

[52] U.S. Cl. ..... 62/81; 62/181; 62/196 C; 62/DIG. 17; 236/1 E

[58] Field of Search ..... 62/181, 174, 196 C, 62/DIG. 17, 175, 238 E, 81, 117; 236/1 EA

[56] References Cited

U.S. PATENT DOCUMENTS

| | | | |
|---|---|---|---|
| 3,316,730 | 5/1967 | Lauer | 62/173 |
| 3,357,199 | 12/1967 | Harnish | 62/181 |
| 3,358,469 | 12/1967 | Quick | 62/196 |
| 3,905,202 | 9/1975 | Taft et al. | 62/152 |
| 4,120,173 | 10/1978 | Kimpel | 62/196 B |

*Primary Examiner*—William E. Wayner
*Attorney, Agent, or Firm*—Merchant, Gould, Smith, Edell, Welter & Schmidt

[57] ABSTRACT

Condensing head pressure in a refrigeration system having its condenser exposed to low outside ambient temperatures is controlled to provide the minimum head pressure required for a given mode of operation. A hierarchy of operating modes, each with its associated pressure is established, including normal refrigeration, evaporator defrost and heat reclaim. The control system prevents system head pressure from going below the minimum required for the operating mode in effect at a given time, with modes requiring higher pressure overriding lower pressure modes when required. In heat reclaim operation, high pressure gas from the compressor is diverted through a heat reclaim coil, and a subcooling sensor or other sensing means controls system head pressure to the minimum pressure that will maintain full condensing in the heat reclaim coil, which is the most economical mode of operation. In a multiple system, head pressures of the various systems are brought up sequentially to the pressure for full condensing in their heat reclaim coils so that if additional heat is needed the next stage is brought in, rather than further increasing the pressure of the previous stages. This has been found to be more economically efficient than providing further increases in head pressure above the optimum point of just fully condensing all vapor entering the reclaim coil to liquid.

13 Claims, 7 Drawing Figures

HEAD PRESSURE CONTROL FOR HEAT RECLAIM REFRIGERATION SYSTEMS

BACKGROUND OF THE INVENTION

The present invention pertains to the field of control systems for controlling condensing head pressure in a refrigeration system which includes heat reclaim coils.

It is well know that in the case of refrigeration systems having condensers exposed to cold outdoor temperatures, the condensing temperature may fall too low for proper system operation, unless steps are taken to maintain condensing head pressure at a desired level. Many techniques for head pressure control are known in the art, including the standard techniques of shutting off condenser fans and partially flooding the condenser by means of a bypass and a control valve. In so-called bypass systems, a control valve, usually at the outlet of the condenser is connected to receive refrigerant from the condenser or from a bypass path, and the control valve operates the system, usually by comparing the condensing pressure to a reference pressure and controlling condenser flooding accordingly. In most prior art systems a fixed reference pressure is used, but a more efficient and advantageous method of controlling head pressure is set forth in our co-pending patent application Ser. No. 759,129, entitled "Refrigeration System Subcooling Control", filed Jan. 13, 1977, now U.S. Pat. No. 4,136,528 and assigned to the assignee of the present application. In that patent application we set forth the technique of raising head pressure to only the minimum pressure required to ensure subcooling and prevent the formation of flash gas at the critical point along the liquid line between the condenser and the thermostatic expansion valve for the evaporator. Sensors are provided for monitoring both subcooling in the liquid line at the entrance to the thermostatic expansion valve or other critical point in the line, and for monitoring a minimum of pressure differential across the expansion valve to ensure proper operation thereof. Appropriate signals from the two sensors are OR'd together and the result used to control the valve which controls flooding of the condenser. This has the advantage of keeping the head pressure high enough (during cold outdoor temperature weather) to maintain operation of the thermostatic expansion valves so that refrigeration capacity is unimpaired, while preventing inefficiencies which would be associated with compressing the refrigerant to any higher pressure.

In recent years the rising cost of energy and increasing emphasis on efficiency have promoted considerable interest in reclaiming the heat rejected by the condenser of a refrigeration system in a manner that will permit its use for heating the comfort conditioned air space in a building. This is particularly true in installations involving multiple refrigeration systems, for example in a supermarket. Typically, a supermarket has a great number of refrigeration devices including walk-in storage areas, open display cases and glass or solid door reach-in refrigeration units. It is common to use multiple systems wherein a number of subsystems may be utilized, each having its own compression, condensation and distribution elements, and each running a number of evaporator loads. During cold weather, the outdoor mounted condensers for the subsystems may be rejecting a considerable amount of heat to the atmosphere, while the heating requirements in the comfort conditioned spaces of the supermarket may be substantial. It has long been recognized that heat otherwise rejected to the atmosphere by the condensers can be reclaimed for use in heating the store. This is done by introducing another heat exchange coil, called the heat reclaim coil, which is usually connected in series between the compressor and the outdoor condenser, but which is placed in thermal contact with the air in the comfort conditioned space, for example in a heating duct. In a conventional heat reclaim system, a fixed head pressure control system limits the minimum condensing temperature and pressure. The minimum condensing pressure is set high enough to provide adequate subcooling for all expansion devices, to provide adequate condensing temperature for gas defrosting, and to provide adequate temperature difference between the heat reclaim coil and its inlet air.

Reclaimed heat from this type of prior art system is often thought to be "free" in that no additional energy input requirements are involved. However, this may or not be correct, depending upon the actual operating conditions. Typically, the heat reclaim coil requires a higher condensing temperature and pressure than either subcooling or defrosting considerations require, because of the design of the heat exchanger, and the fact that it is interfacing with air that is already in the 60° F. to 70° F. range. The higher condensing temperature and pressure causes the compressor motor power consumption and running time to increase in order to maintain the higher head pressure, and this increased energy input into the system required for heat reclaim operation must be considered when examining heat reclaim economics. For example, in prior art systems that use a fixed high head pressure and temperature for reclaim, energy is lost during the time that the environmental control thermostat in the supermarket is not calling for additional heat and the heat reclaim coil is temporarily switched out of the circuit. In that situation, the head pressure is maintained higher than required for either defrosting or for subcooling at the expansion devices and the extra energy expended by the compressor motors tends to offset the supposed savings in heat reclaim. Some prior art systems have proposed to eliminate some of this waste by switching between two fixed head pressures, a lower one when reclaim is not being used, and a higher one when it is. Although that method improves efficiency somewhat, all prior art systems are still subject to inefficiencies as follows.

In prior art systems, the condensing pressure and its corresponding temperatures for heat reclaim are usually selected in consideration of the design of the heat reclaim coil, and the heating requirements of the store. If more heat is required in a given application, it is possible to recover more heat from the reclaim coils simply by raising the system head pressure. However, it has not generally been recognized heretofore that increasing the head pressure beyond a certain point leads to a region of operation where the energy input cost for the additional heat that is reclaimed is not economically competitive with the costs of equivalent heat produced through the burning of fossil fuels.

We have determined the points of maximum efficiency of heat reclaim, and we have devised our control system to take advantage thereof.

In one aspect of the present invention, we provide a control system for a refrigeration system of the type including a condenser which is, at least at some times, subject to low ambient temperatures, and a heat reclaim coil for recovering heat into the building. A hierarchy of condensing temperatures and pressures is established, corresponding to the needs of various modes of operation including normal refrigeration, defrosting, and heat reclaiming. Sensors and control devices are provided for controlling system pressure to the minimum pressure required by the highest pressure mode in the hierarchy which is active at a given time. When neither defrost nor reclaim is required, head pressure is held to the minimum required to insure subcooling and minimum pressure differential at the expansion devices. When defrosting is required, heat pressure is boosted into an amount required for that mode of operation.

According to another aspect of the invention, when heat reclaim is required, a diverting valve is activated so that the condenser will discharge into the heat reclaim coils, which in turn will discharge into the outdoor condenser. If only a small amount of heat reclaim is required, head pressure is not boosted, but is left under the control of lower pressure modes. In this manner, some heat reclaim takes place by desuperheating in the coil.

If additional heat is required by the thermostatic control system in the building, the control system of the present invention increases the amount of heat reclaim by causing the condensing pressure, and temperature to be controlled so as to maintain the point of complete condensation at or near the output of the heat reclaim coil. In the preferred embodiment, this is accomplished by the use of a subcooling sensor positioned at the output of the heat reclaim coil, and connected to control head pressure to maintain a slight amount of subcooling at that point. It has been determined that further increasing head pressure above that point, while resulting in additional heat output from the reclaim coil, rapidly becomes as costly as supplying the additional heat requirement with electrical resistance heat. Where fossil fuel heat is available, it is preferable to bring furnaces into play when heating requirements exceed the above-mentioned optimum heat reclaim operation points.

In the case of multiple refrigeration systems, comprising a plurality of subsystems, the present invention provides a sequence control for successively bringing the individual subsystems into heat reclaim mode with increasing heating demands in the building. The diverter valves are first activated, either sequentially, or in unison to bring the heat reclaim coils for the various subsystems into the desuperheat mode. If more heat is needed, a first subsystem is brought to full condensing in the heat claim coil by placing its pressure control valve under control of the subcooling sensor for the heat reclaim coil. If additional heat is needed, the next subsystem is brought up to full condensing in the reclaim coil, and so on until all subsystems are in that condition. If additional heat is then needed, fossil fuel furnace heating units are brought into play. In case suitable fossil fuel heating units are not available, electric resistance heating, or further increased head pressure in the refrigeration systems can be utilized, but at a much higher cost, per unit of heat energy.

SUMMARY OF THE INVENTION

One aspect of the invention provides head pressure control for a refrigeration system of the type which is capable of different modes of operation. A number of operating conditions of the system indicative of operation thereof in each of said modes are sensed, and the system condensing head pressure is controlled so as to maintain refrigeration system head pressure at or near the optimum pressure requirement for the active mode having the highest pressure requirement. In a preferred embodiment, the different pressure requirements are for normal refrigeration, heat reclaim and gas defrost. In normal refrigeration, subcooling of the liquid line and differential pressure across the expansion device of one or more evaporators are used to monitor for predetermined minimum values that will ensure proper system operation. In one mode of heat reclaim operation, subcooling is sensed at or near the outlet of the heat reclaim coil to sense for substantially full condensation within the coil. For gas defrost, head pressure is sensed and compared to a predetermined value for initiating gas defrost.

According to another aspect of the invention, a plurality of refrigeration systems forming a multiple refrigeration system are controlled for optimum heat reclaim. The heating requirement within the building or other use of the reclaim heat is sensed, and diverter valves for the heat reclaim coils are operated, either simultaneously or sequentially, in response to a first level of heat requirement. In response to further heat requirements, the subsystems are activated sequentially to raise head pressure to maintain substantially full condensation in their associated reclaim coils.

DESCRIPTION OF THE PREFERRED EMBODIMENTS

Figure 1:
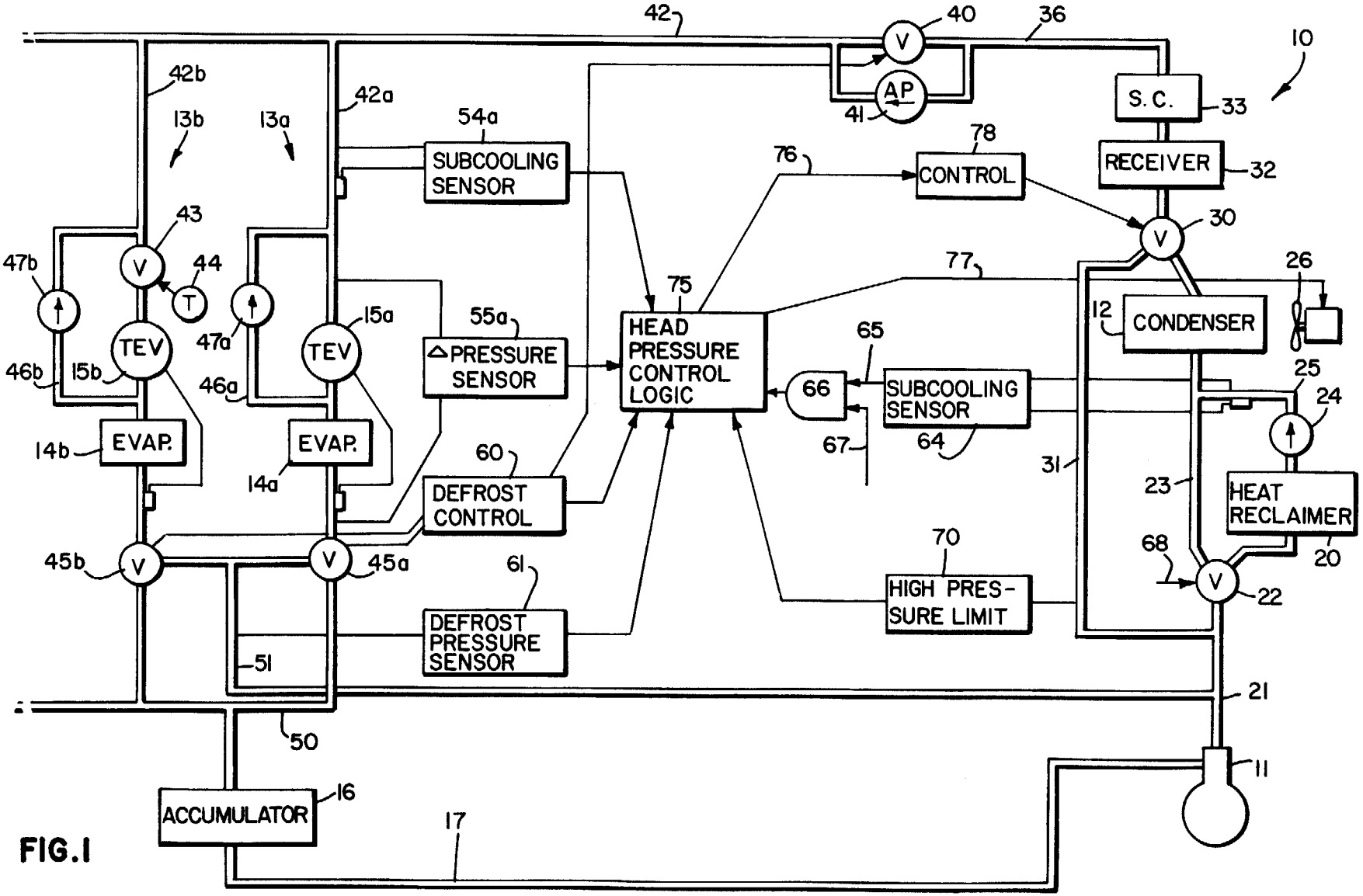
FIG. 1 is a schematic diagram of a refrigeration system utilizing a control system according to one aspect of the present invention.

Referring to FIG. 1, reference number 10 generally designates a refrigeration system utilizing the control system of the present invention. System 10 may be the only system or it may be one of a number of subsystems in a multiple system installation. System 10 includes one or more compressors 11, a condenser 12, and a plurality of evaporator load circuits **13*a* and 13*b*, it being understood that a greater number of evaporator circuits could be used. Evapo ·ator load circuit 13*a* includes thermostatic expansion valve 15*a* and evaporator 14*a*, with the other evaporator circuit including corresponding parts correspondly numbered but with the "b" designation rather than "a". The evaporator circuits eventually discharge to an accumulator 16 which connects by suction line 17** back to the compressor.

System 10 also includes a heat reclaim coil which is indicated by reference number 20. The discharge line 21 from the output of compressor 11 connects to a diverter valve 22. This is a three-way valve which is controlled by the control system as will be explained hereinafter, to direct the hot vapor from the compressor either to condenser 12 by way of conduit 23 or to heat reclaim coil 20. The outlet of heat reclaim coil 20 passes through a one-way check valve 24, and then through conduit 25 to rejoin conduit 23 and to the input of condenser 12. Heat reclaim coil 20 is of course mounted within the building, or within air handling ducts for the comfort conditioned space in the building, while condenser 12 is mounted in thermal contact with outside air, usually by mounting it on the roof of the building. A motor driven fan 26, or a plurality of fans may be provided in conjunction with condenser 12 for adjusting the efficiency of condensing taking place therein.

The discharge from condenser 12 connects to one input of head control valve 30. The other input to this valve is bypass conduit 31, which branches from discharge line 21, bypassing both the condenser and the heat reclaim coil. The use of a condenser bypass line and a control valve for flooding the condenser to thereby control system head pressure is well known in the prior art. However, as will be explained hereinafter, the particular type and degree of control exercised through valve 30, in conjunction with heat reclaim and other system needs is novel in the present system.

The outlet of control valve 30 connects to a receiver 32, whose output connects to a subcooler 33. These elements are found in conventional systems and perform generally the same functions here. Subcooler 33 may be a separate heat exchange coil in contact with outside air, or it can be physically mounted with condenser 12. The output of subcooler 33 connects via line 36 to a solenoid valve 40, which is connected in parallel with a differential pressure check valve 41. These components come into play in conjunction with a hot gas defrost mode, as explained hereinafter. Liquid line 42 continues from valves 40 and 41, and serves to distribute refrigerant to the various evaporator load circuits 13. In a typical installation, liquid line 42 may be quite lengthy, as it extends from the general location of the condenser and its associated components, which typically would be located on the roof of a building, to the general location of the cold storage lockers, refrigerated display cases, etc. which form the evaporator circuit loads for the system.

Liquid line 42 branches at 42*a* to feed evaporator circuit 13*a*, and at branch 42*b* for evaporator circuit 13*b*, and continues as indicated in broken line to the number of evaporator load circuits in a given system.

The following description of the components in evaporator circuit 13*a* applied also to the similarly numbered components in circuit 13*b*.

Liquid line 42*a* connects to thermostatic expansion valve 15*a*. Thermostatic expansion valve 15*a* discharges into evaporator coil 14*a*. A branch 46 extends from the output of the thermostatic expansion valve, to liquid line 42*a*, and includes a check valve 47*a*. These components are used during defrost as explained hereinafter.

Thermostatic expansion valve 15*a* is preferably of the balanced port design, and it is controlled by sensing superheat at the outlet of the evaporator.

The output of evaporator 14*a* connects to a reversing valve 45*a*, which is used during defrost as explained hereinafter. The output of valve 45*a* discharges to the collector line 50, which connects also to the discharges from all of the evaporator loads, and delivers the gas to accumulator 16. The other connection to reversing valve 45*a* is to a branch of defrost line 51, whose other line connects from discharge line 21 of the compressor.

Evaporator load circuit 13*b* includes a solenoid valve 43 in liquid line branch 42*b*. It is connected for control in the conventional manner by a thermostat 44 which is placed in or adjacent the refrigerated space to control the temperature therein.

A number of sensing and control components are indicated in schematic or block diagram form in FIG. 1 as follows. Subcooling sensor 54*a* is provided in association with evaporator circuit 13*a*, as is differential pressure sensor 55*a*. These components provide appropriate output signals as to the degree of subcooling (or lack thereof) and pressure differential near the end of liquid line 42*a*. Subcooling sensor 54*a* may use a sensing bulb and a pressure tap in thermal contact with the liquid line, or other temperature and pressure sensing devices to measure subcooling in the liquid line. Differential pressure sensor 55*a* includes pressure taps on the expansion valve inlet and the evaporator outlet.

The functions of subcooling sensor 54*a* and differential pressure sensor 55*a* are basically the same as disclosed in our co-pending patent application mentioned above. Appropriate control signals are generated in response to the sensed conditions to maintain system head pressure at least at the minimum level to ensure proper operation of the thermostatic expansion valve and evaporator.

It will be understood that evaporator load circuit 13*b*, and all other such circuits may also include subcooling sensors 54 and differential pressure sensors 55, but they have been omitted from FIG. 1 for purposes of clarity. Whether or not additional subcooling and pressure differential sensors are required depends upon the specific building layout. At least one subcooling sensor must be operative and sending signals to head pressure control logic 75 at all times. If the point of greatest heat gain or pressure drop moves from place to place on liquid line 42, sensors must be attached at all points where the worst case can appear. Subcooling sensors attached to lines for evaporator circuits not in use must not send signals to logic 75. Differential pressure sensors 55 should be used with subcooling sensors on all systems with evaporating saturation temperatures above 10° Fahrenheit. As explained more fully in our co-pending patent application identified above, the ideal location for subcooling and differential pressure sensors is at the end of a liquid line in association with an evaporator load that is always refrigerating, except when in defrost. Thus, an ideal evaporator load would be one like evaporator circuit 13*a*, where temperature is controlled by suction pressure either by compressor cycling or by an evaporator pressure regulator as are generally known in the art. If temperature control for all evaporator loads is by thermostat and solenoid valves as load 13*b* of FIG. 1, then all loads may have sensors. When a particular load is switched off under thermostatic control, its sensors should be disconnected or disabled by suitable logic controls.

Reference number 60 refers to a defrost control system as explained hereinafter. It includes control lines connected for controlling the operation of reversing valves 45*a* and 45*b*. A defrost pressure sensor 61 is connected to sense pressure in defrost line 51, or discharge line 21 of the compressor, in the case of hot gas defrost. It will be understood that the present invention is equally usable with any type of defrost system including hot gas, desuperheated gas or electric defrost, and including systems which defrost under time control, temperature control or frost detection control, as are generally known in the prior art.

Reference number 64 designates a subcooling sensor which works in connection with the heat reclaim control portion of the present invention. Subcooling sensor 64 is connected to sense the degree of subcooling at or near the discharge of heat reclaim coil 20. For convenience, subcooling sensor 64 may be the same type of device as sensor 54. In FIG. 1, a pressure tap and a sensing bulb in thermal contact with line 25 are indicated, but it will be understood that any type of measurement device for measuring pressure, temperature and determining therefrom the degree of subcooling can be used. Subcooling sensor 64 provides an output on control line 65 indicative of the subcooling at refrigerant line 25, and this control connects as one input to an AND gate 66. The other input to gate 66 is supplied by lead 67 as explained below.

A high pressure limit sensing device 70 is provided and is connected to a suitable point somewhere in the discharge line 21 of compressor 11.

As indicated by the arrows in FIG. 1, subcooling sensor **54*a*, differential pressure sensor 55*a*, defrost control 60, defrost pressure sensor 61, high pressure limit switch 70, and AND gate 66 from from subcooling sensor 64 all provide control signal inputs to the head pressure control logic, which is indicated by box 75. One embodiment of this logic is explained hereinafter with reference to FIG. 4, but a general description of its function will be set forth here in connection with the description of the operation of the system of FIG. 1**.

Generally, head pressure control logic 75 and the various sensors establish a hierarchy of pressure demand and control functions for the various modes of operation. Suitable output signals are provided over control lines 76 and 77 to control the system head pressure. Line 76 leads to the head pressure control for valve 30, indicated by reference number 78. This control serves to regulate the operation of valve 30, in response to control signals from logic 75, to maintain the appropriate degree of condenser flooding for the desired head pressure. In the preferred embodiment, control 78 may be a heat motor variable reference pressure generating device to establish the operating point of valve 30, as is generally set forth in our above-mentioned co-pending patent application. It will be appreciated however, that other types of control technologies could be used for achieving generally the same control over condenser flooding as set forth herein. Control line 77 is used to control operation of motor driven fan or fans 26 which of course also have an influence on condenser effectiveness and condensing pressure.

Description of the Operation of FIG. 1

The operation of the system of FIG. 1 will now be explained with reference to three modes of operation: normal refrigeration, defrost, and heat reclaim. It will be appreciated at the outset that during very warm outdoor temperatures as in the summer, the condenser will be exposed to high ambient temperatures and the condensing pressure and temperature will float or follow this temperature. In general, the head pressure during this time of year is high enough for all system requirements, and the control system does not actually attempt to intervene, but allows the condensing temperature to move in response to outdoor temperature. If for some reason, the head pressure should fall below that required for a given mode of operation, the control system becomes active to maintain the required pressure. Incidentally, although heat reclaim is usually thought of in terms of wintertime operation, a heat reclaim coil may be used during summertime in conjunction with air conditioning equipment, for reheating air which has been dehumidified. The present invention contemplates this mode of use also.

In normal refrigeration operation, compressed gas from compressor 11 passes through diverter valve 22 and line 23 to condenser 12. It is assumed for the moment that no heat reclaim is required. Condensed liquid eventually proceeds through receiver 32, subcooler 33 and valve 40 to liquid line 42 to the evaporator loads. With reference to evaporator circuit **13*b*, liquid passes through valve 43, as required under control of refrigeration temperature control thermostat 44. When valve 43 is open, liquid is delivered to thermostatic expansion valve 15*b*, which meters it to evaporator 14*b* in the conventional manner. The discharge from evaporator 14*b* passes through valve 45*b* to collector line 50, accumulator 16, a sunction line 17 and back to compressor 11**. The compressor may comprise a plurality of compressors with suitable suction sensing controls for cycling them as required, either in unison or sequentially, as is generally known in the prior art.

The operation of evaporator load **13*a* is similar, except that no thermostatically controlled valve is involved in the type of load represented by load 13*a***, as previously described.

In normal refrigeration just described, subcooling sensor **54*a* and differential pressure sensor 55*a* (together with the corresponding sensors for the other evaporator circuits) are in control of system head pressure. If the pressure drops low enough to eliminate subcooling (plus any safety margin which may be programmed into sensor 54*a*), or, the differential pressure across expansion valve 15*a* should become too low, head pressure control logic 75 will shut down fans and/or further flood condenser 12 by means of control 78 and valve 30**, to maintain the minimum required head pressure. In this mode, the operation is essentially as described in our above-mentioned copending patent application.

During defrost mode, system operation is as follows. A defrost cycle may be initiated by defrost control 60 in any conventionally known manner, for example by a clock on a preprogrammed defrost schedule, or by a frost or temperature sensor associated with an evaporator. When the defrost cycle is initiated for evaporator circuit **13*a*, for example, head pressure control logic 75 causes operation of control valve 30 and fans 36** to initiate a rise in the condensing pressure (assuming pressure was not sufficient already) to the preselected level for the defrost cycle.

A certain amount of time may be required for the actual rise of head pressure, and when sufficient pressure is attained as detected by sensor 61, defrost control 60 activates reversing valve **45*a*, and closes solenoid valve 40. Evaporator 14*a* is then cut off from collector line 50, and is connected to defrost line 51. Hot gas flows backwards through evaporator 14*a*, where the frost is melted and the gas is condensed. Condensed liquid continues through branch 46*a* and check valve 47*a* to liquid line 42*a*. With the closing of valve 40, the liquid line pressure drops until the differential pressure check valve 41 opens, maintaining a predetermined pressure drop between line 36 and line 42**, thus ensuring that a suitable pressure differential exists across evaporator 14a for the defrost operation. The liquid from the evaporator being defrosted mixes with liquid in line 42 and is supplied for refrigeration use in the other evaporator circuits, as is generally known in the prior art.

During the gas defrost cycle, pressure sensor 61 is in control of the system head pressure, and valve 30 and fan or fans 26 are controlled as required to maintain the defrost pressure.

At the termination of the defrost cycle, by the lapse of a predetermined time, or as determined by a frost or temperature sensor as is generally known in the prior art, the defrost cycle is terminated and valves 45a and 40 are returned to normal refrigeration modes, and head pressure control returns to normal refrigeration as discussed above, and head pressure eventually drops to the values set by sensors 54a and 55a.

For heat reclaim mode operation, the first stage of operation is accomplished by a suitable control signal to control line 68, which operates diverter valve 22. The origin of the control signal for line 68 is explained hereinafter with reference to FIG. 2, but for present purposes it will be understood that for the first stage of heat reclaim, valve 22 is switched to bring heat reclaim coil 20 into a series path with condenser 12. In this first stage of heat reclaim, no attempt is made to elevate or control heat pressure for heat reclaim purposes, and head pressure remains under control of normal refrigeration or defrost modes as explained above.

During the second stage of heat reclaim, system head pressure is placed under control of subcooling sensor 64. This can be done by a suitable enabling signal on control line 67, which enables the output of subcooling sensor 64 to be passed through gate 66 to control logic 75. Control valve 30 and fans 26 are then controlled to establish and maintain operation with substantially full condensation taking place near the end or outlet of heat reclaim coil 20.

High pressure limit sensor 70 serves as an over ride to cause the head control logic to reduce head pressure if an excessively high pressure is reached.

Figure 2:
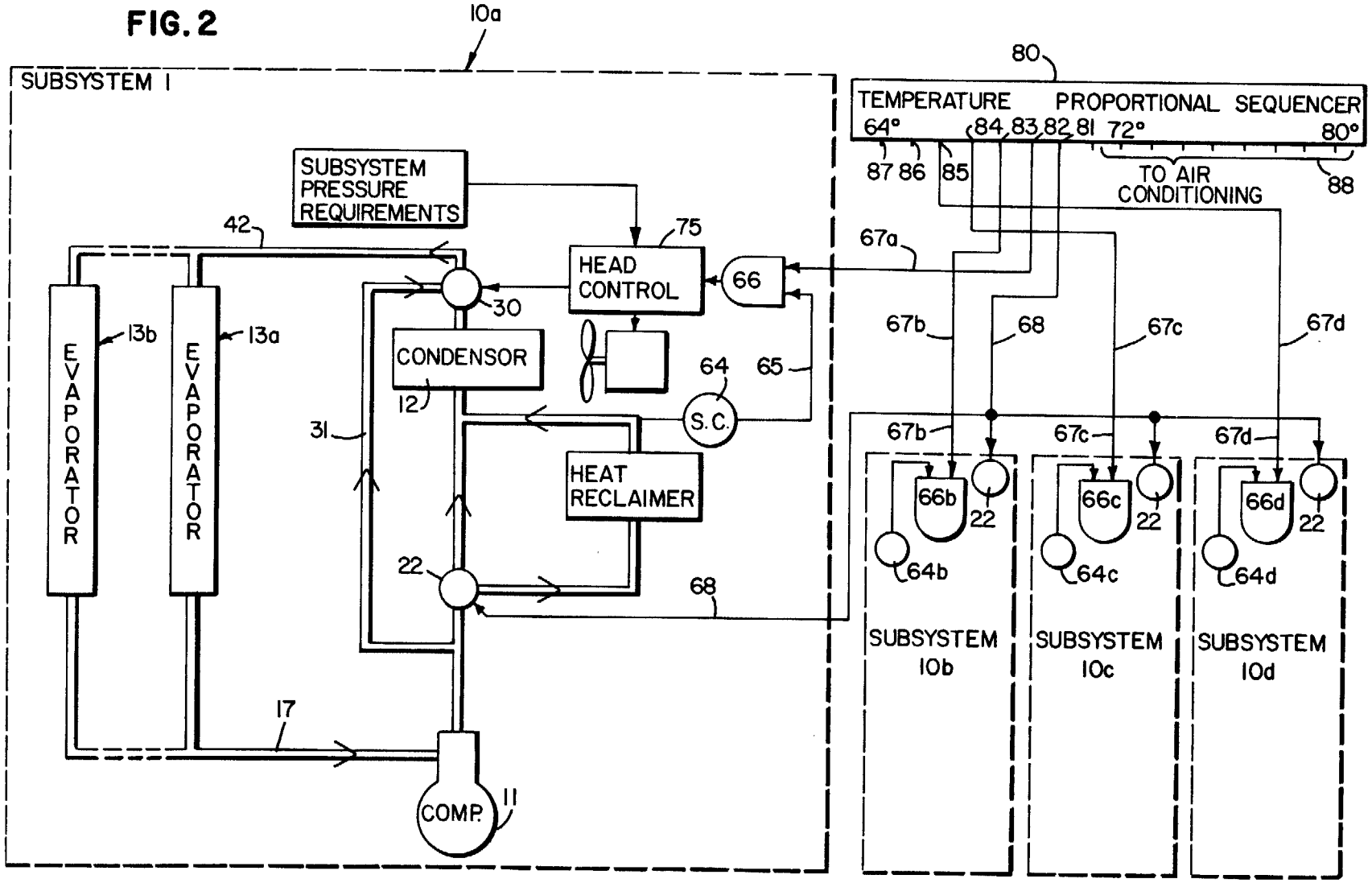
FIG. 2 is a schematic diagram of a multiple refrigeration system according to another aspect of the invention.

Referring now to FIG. 2, a multiple system is shown in schematic form. Subsystem 10a is basically the system 10 of FIG. 1, and like components are identically numbered as in FIG. 1. However, for purposes of clarity, some of the components have been deleted from the drawing of FIG. 2, but it will be understood that they are intended to be provided in the manner indicated in FIG. 1. In FIG. 2, reference numbers 10b, 10c and 10d indicated additional subsystems which are generally similar to subsystem 10a. Of course it will be understood that since different subsystems will typically be designed for particular refrigeration loads within the building, there will of course be differences in the numbers of evaporator load circuits, and possibly in the size and capacity of other components, as will be apparent to those skilled in the art.

In FIG. 2, subsystems 10b, 10c and 10d have AND gates 66, subcooling sensors 64, and diverter valves 22 corresponding to those in subsystem 10a. These components are designated with the appropriate postscript b, c or d for the corresponding system. The AND gates 66 and diverter valves 22 are operated in sequential manner according to the heat demand in the building as follows.

In FIG. 2, reference number 80 designates a temperature proportional sequencer which is the main environmental temperature control unit for the comfort conditioned space in the building. Sequencer 80 is a thermostatic device with means for setting a set point temperature, for example 72° F., and a plurality of outputs which are sequentially and progressively actuated or switched as the sensed temperature departs further from the set point. In FIG. 2, sequencer 80 shows 5 outputs indicated by reference number 88, which would be used for interfacing with an air conditioning control as may be provided in the prior art.

Outputs 81 through 87 are used for reclaim heat or auxiliary heat control. Output 81 is the first output switched as temperature drops below the set point, and so on, with output 87 being the last, as the sensed temperature drops considerably below the set point. Commercially available sequencers may also have an adjustment for the temperature width of the operating range, and by way of example the sequencer shown in FIG. 2 has the reference temperatures 80° and 64° written in. A wider or narrower range of operation may be desirable depending upon the particular installation.

Output 81 connects to lead 68, which branches to each of the subsystems 10a to 10d. Lead 68 operatively connects to the control mechanism for each of the diverter valves 22. In the embodiment shown, all diverter valves are switched when output 82 becomes active. The present invention also contemplates an embodiment in which successive temperature outputs from sequencer 80 would be used to switch the diverter valves of the various subsystems in sequence, if desired.

Control line 67a, which feeds one input to AND gate 66 to subsystem 10a, has its other end connected to output 82 from sequencer 80. In similar manner, control line 67b for subsystem 10b connects to output 83. Outputs 84 and 85 connect respectively to control lines 67c and 67d for the remaining two subsystems.

Sequencer outputs 86 and 87 and possible additional outputs depending upon the particular system design, are used for activating all auxiliary heat devices such as furnaces or resistance heat, depending upon the particular installation. In the alternate embodiment of FIG. 7 output 86 may be used for another heat reclaim mode as explained further below.

It will be understood that although four subsystems are shown in FIG. 2, a greater or lesser number could be used, with corresponding changes in the number of outputs provided by sequencer 80.

Description of the Operation of FIG. 2

Figure 3:
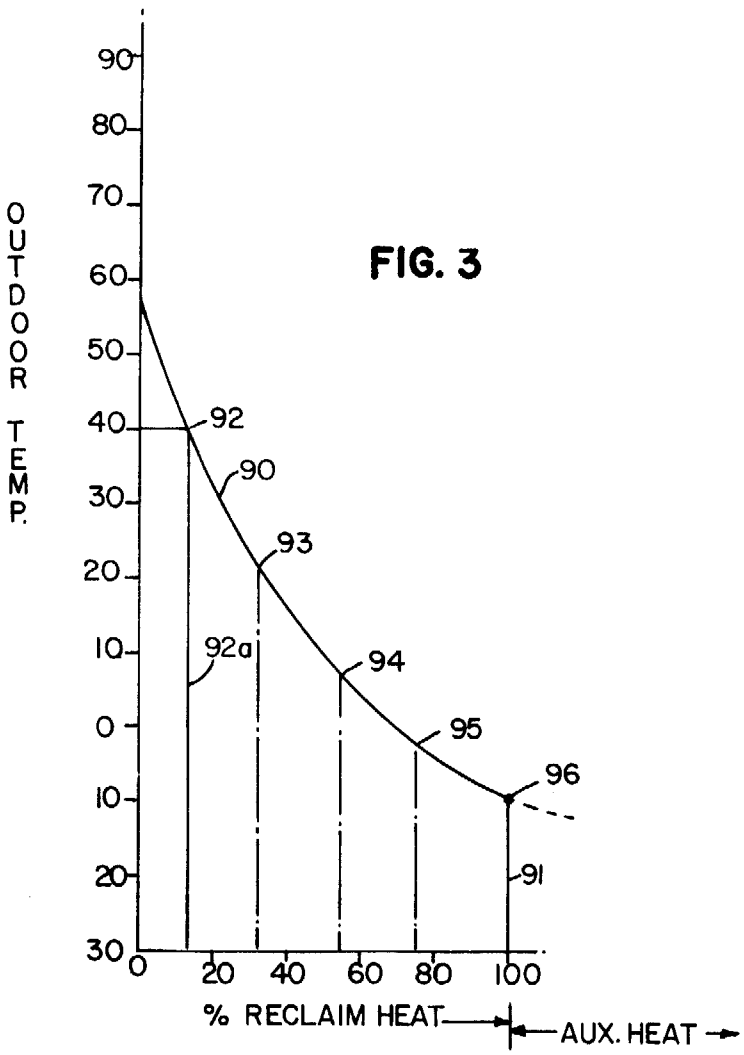
FIG. 3 is a graph illustrating the operation of the system of FIG. 2.

Operation of the heat reclaim sequencing aspect of the present invention will now be explained with reference to FIGS. 2 and 3. In FIG. 3, the vertical axis represents the outdoor temperature to which the building is exposed. It is assumed of course that the heating requirements within the building have a direct relationship to the outdoor temperature. The horizontal axis indicates the amount of heat being put into the building by heat reclaim and auxiliary heat, with increasing amounts to the right in the graph. The first portion of the horizontal axis up to line 91 shows increasing percentages of available reclaim heat, while to the right of line 91 auxiliary heating devices such as furnaces or electrical resistance heat would be required.

Curve 90 represents the heating requirements within the building in response to the outdoor temperature.

Above approximately 85° F. ambient temperature, head pressure is allowed to float in response to temperature, and head pressures are in general high enough for all purposes, so no positive control is required. Between approximately 85° F. and 55° F. no additional head input is required. Even at outdoor temperatures somewhat below the comfort conditioned temperature, enough heat is generated by electric lights, people and the effects of sunshine to maintain temperature in the building. During this range, however, the natural head pressure of the system may not be sufficient for subcooling or defrosting requirements, and the control system 75 of FIG. 1 in association with its various sensors and control devices may control head pressure to the desired level as explained earlier with reference to FIG. 1.

Below about 55° F. it is necessary to add heat input to the building. As previously explained, the first stage of reclaim heat is to activate diverter valves 22 so that heat reclaim coils 20 will begin to desuperheat and provide some heat to the building. The diverter valves for the various subsystems can be brought in sequentially, in response to increasing heat requirements, or, as in the case of the embodiment of FIG. 2, all can be brought on in unison. In the example shown in FIG. 3, desuperheating might account for 5 to 15 percent of the available heat reclaim, depending upon the compression ratio of the compressors. It will be appreciated that curve 90 in FIG. 3 represents a time average in the heat requirement and heat output, since of course when a particular stage of heat is brought on, it will tend to overshoot the requirement, but the temperature proportional sequencer 80 will tend to turn it off and the temperature will slowly decay to the next cycle.

When the point is reached where more heat is required than can be delivered with all systems in desuperheat, the first subsystem is switched into full heat reclaim in accordance with the present invention. In the example shown in FIG. 3, this point occurs at approximately 40° F. ambient, but it will be appreciated that this figure is only by way of example, as conditions will vary according to a given installation. This point is indicated in FIG. 3 by reference number 92, and the area to the left of point 92*a* represents the desuperheat region of operation.

As the outdoor temperature drops lower, output 82 of sequencer 80 causes the first system 10*a* to increase its head pressure to maintain a slightly subcooled condition at the outlet of its heat reclaim coil. This point of operation is cycled off and on by sequencer 80 as required, until at an approximately 25° F. outdoor temperature in the example shown, this system is continuously on and delivering its maximum heat reclaim at the optimum operating point. Between points 93 and 94 on the graph, subsystem 10*b* is brought into play. Similarly, between points 94 and 95 a third system is brought in and so on until at point 96 all 4 systems, in this example, are delivering full heat reclaim at their optimum operating point.

If the outdoor temperature drops still further, below minus 10° F. in this example, one or more furnaces, electrical resistance heating elements, or the like are brought into play by outputs 86 and 87 of sequencer 80. As previously explained, while additional heat could be obtained from the heat reclaim coils by further raising of the head pressure beyond the operation at point 96 of FIG. 3, the cost of the heat thus generated in terms of electrical input to the compressor is not economically competitive with other heating systems.

Figure 7:
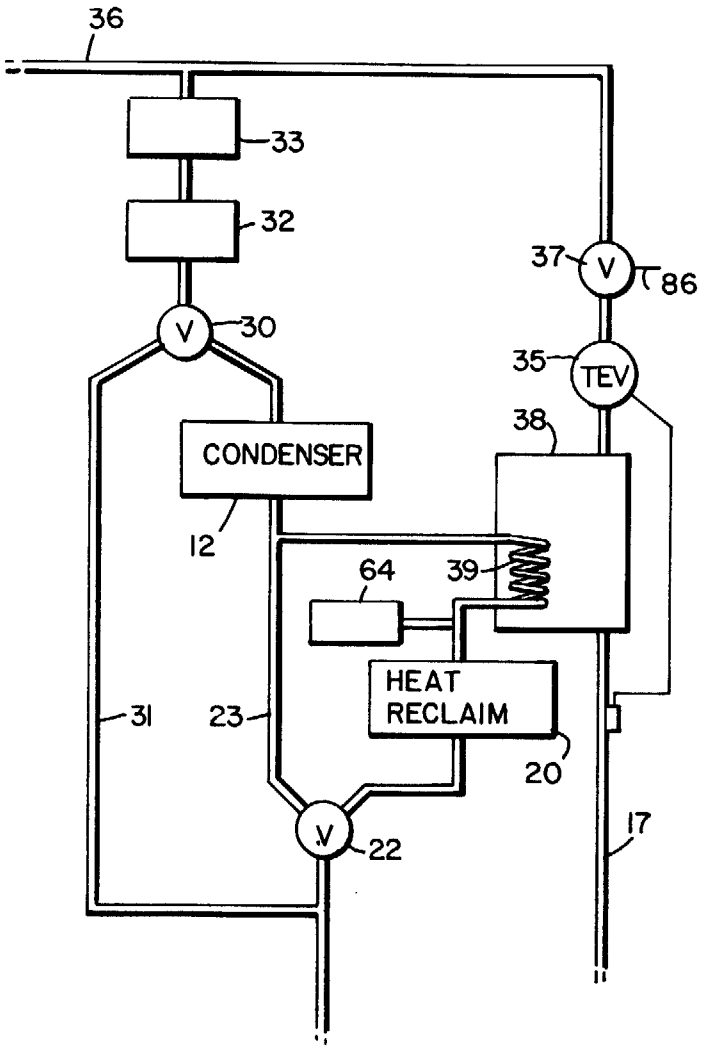
FIG. 7 is a schematic diagram of an alternate embodiment for the system of FIG. 1.

FIG. 7 shows an alternate embodiment that could be used in the system of FIG. 1. In FIG. 7, diverter valve 22, heat reclaim coil 20, condenser 12, line 23, bypass 31, head control valve 30, receiver 32, subcooler 33 and line 36 may be the same as the like numbered components in FIG. 1. However, FIG. 7 includes a heat exchanger 38 connected between the outlet of heat reclaim 20 and the inlet of condenser 12. Specifically, refrigerant passing from the heat reclaim coil is routed through a coil 39 within heat exchanger 38. Subcooling sensor 64 for the heat reclaim mode is preferably connected to sense subcooling at the outlet of heat reclaim coil 20 prior to heat exchanger 38.

A branch of liquid line 36 connects through a control valve 37 to a thermostatic expansion valve 35. The outlet from valve 35 connects to heat exchanger 38, and the outlet of the heat exchanger connected to a branch of suction line 17 for the system. Expansion valve 35 is controlled in a conventional manner by a sensing bulb at the outlet of heat exchanger 38, and it will be appreciated that heat exchanger 38 serves as the evaporator for refrigerant flowing through the path.

The purpose of heat exchanger 38 is to cool the condensed liquid from the outlet of heat reclaim 20 to outdoor ambient temperature, so that it will not lose any more heat to the outdoors when passing through condenser 12. During cold outdoor temperature operation in heat reclaim mode as previously described, it will be appreciated that the air in contact with reclaim coil 20 may be 60° to 70° F., for example, while the outdoor ambient may be much colder. Therefore, even when the refrigerant is fully condensed in reclaim coil 20, the condensed liquid will be at a relatively warm temperature, and it will lose heat to the outdoors in condenser 12, receiver 32 or subcooler 33. By refrigerating the liquid in heat exchanger 38 before it is allowed to pass to the outdoor components, the additional heat is given up inside the building rather than to the outdoors.

The cost of refrigerating the liquid discharging from heat reclaim coil 20 is the additional energy input to the compressors for handling the refrigerant flow through the branch which includes heat exchanger 38, since this refrigerant flow is not being used to cool the refrigeration cases in the building. However, it has been determined that the energy saved by not rejecting heat to the outdoors, as compared with the energy in terms of additional compressor work, compares favorably to the cost of some types of auxiliary heat, especially to electrical resistance heating. Accordingly, it may be desirable in some installations to use the alternate embodiment of FIG. 7 in the system of FIG. 1, or in one or more of the subsystems of FIG. 2. In that case, control valve 37 would be connected for control by output 86 of temperature proportional sequencer 80 of FIG. 2. Use of heat exchanger 38 to refrigerate the outlet of the heat reclaim coil would then represent a third stage of heat reclaim, following desuperheating as controlled by output 81 of FIG. 2, and full condensing within the heat reclaim coils as controlled by outputs 82 through 85 of FIG. 2. If the first two states of heat reclaim do not provide enough heat, output 86 would then open valve 37 to begin refrigeration of the heat reclaim coil discharge. In a multiple system as in FIG. 2, valves 37 for all subsystems could be opened in unison, or additional outputs of sequencer 80 could be used to bring them on sequentially, if desired. Auxiliary heat from furnaces would be brought on by output 87 only after all subsystems equipped for this third stage of heat reclaim were in full reclaim operation.

It will be appreciated that in some buildings a certain amount of outside air is brought into the building and mixed with the air being circulated through the ventilation and heating system within the building. This so-called "make-up" air may amount to a small percentage of the total amount of air being handled through the heating ducts. In this type of system additional efficiency can be achieved by using an additional heat exchange coil in the make-up air duct. This coil would be connected to receive the discharge of the heat reclaim coil, and would in turn discharge to condenser 12. Since during cold weather operation, the air in the make-up duct is colder than the air flow across the heat reclaim coil, additional heat can be extracted from the refrigerant and maintained in the building before it passes to the condenser.

Figure 4:
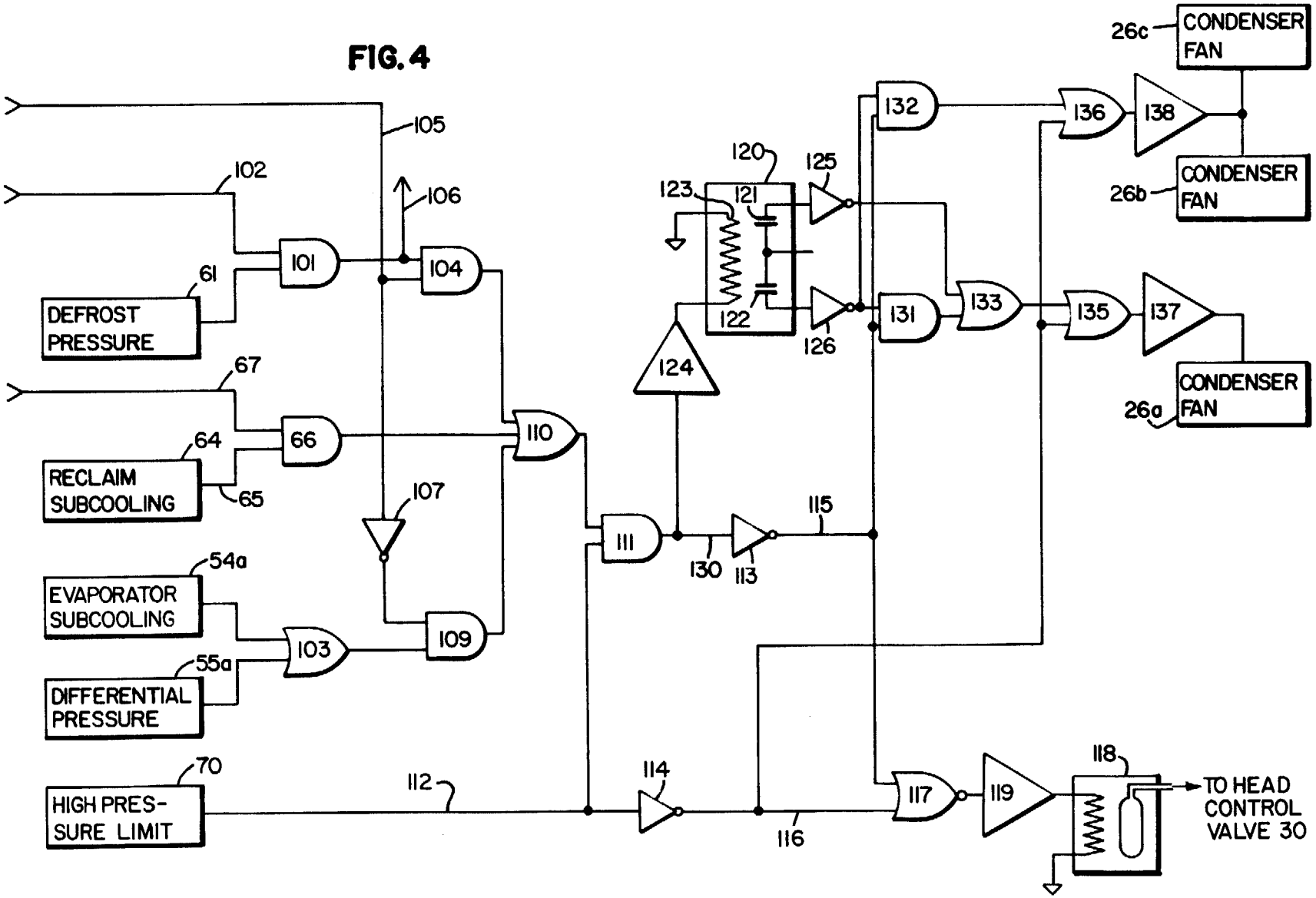
FIG. 4 is a logic diagram of the control system of the refrigeration system of FIG. 1, according to one preferred embodiment of the invention.
Figure 5:
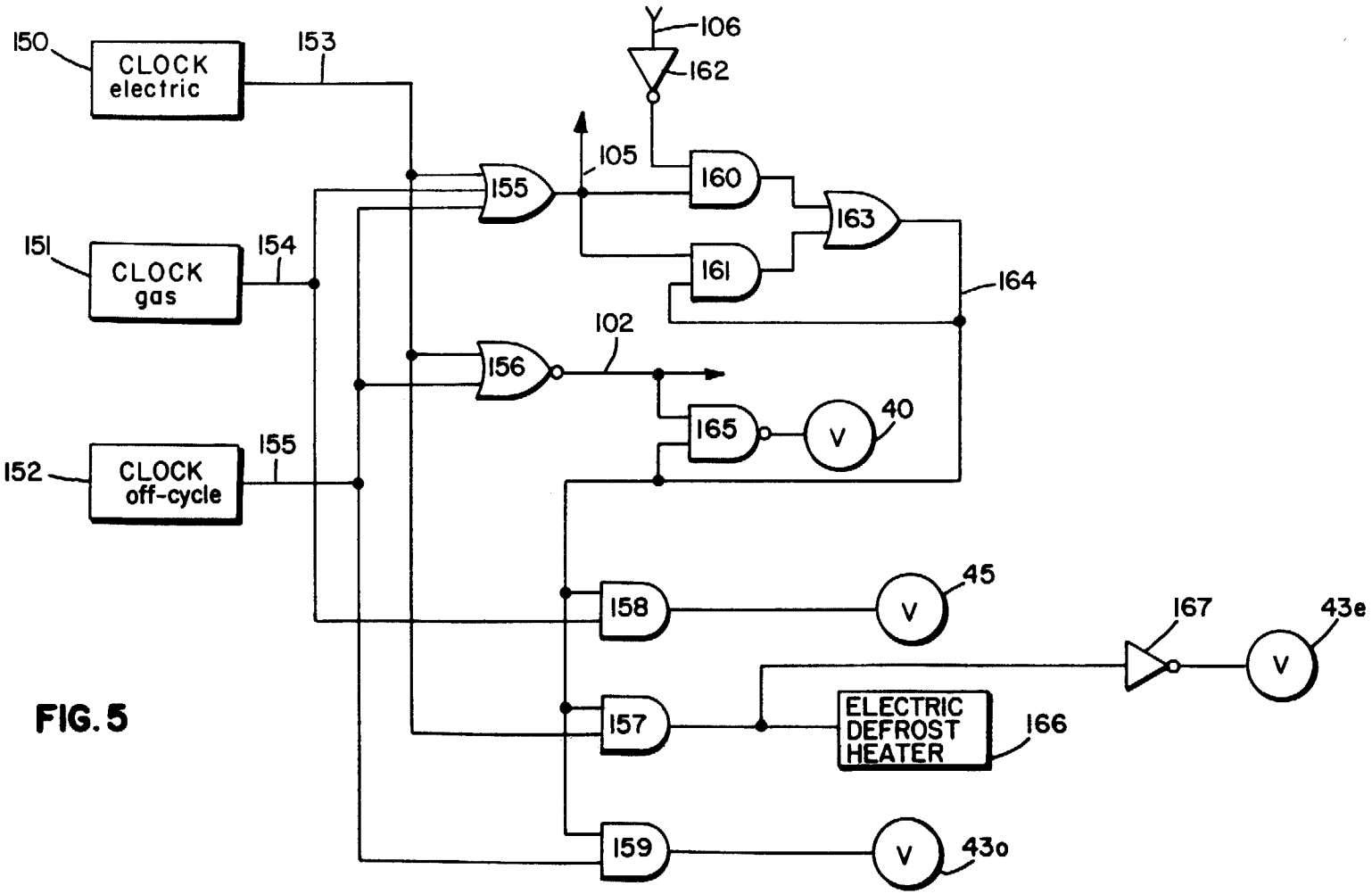
FIG. 5 is a logic diagram of a defrost control portion of the control system according to the present invention.
Figure 6:
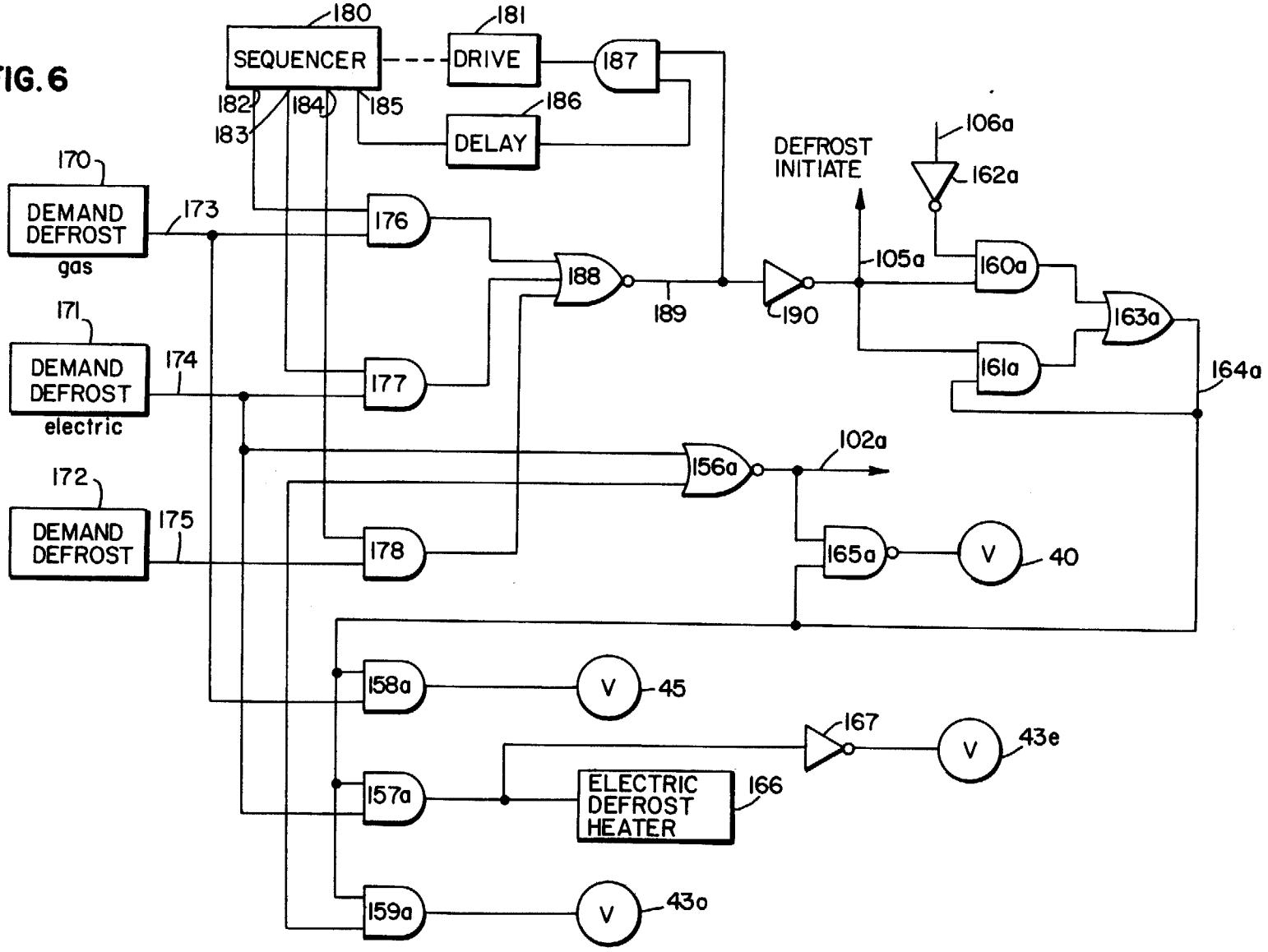
FIG. 6 is a logic diagram of an alternate embodiment of a defrost control of the present invention.

Referring now to FIG. 4, the head pressure control logic and the controls for operating condenser flooding control valve 30 and fans 26 are shown. FIG. 4, and also FIGS. 5 and 6 are in the form of logic diagrams using conventional symbols for AND, OR and other gates. It will be appreciated that the control functions set forth can be implemented in any desired technology, including but not limited to, transistor or intergrated circuit logic gates, electrical relays or mechanical or fluidic controls, as will be apparent to those skilled in the art, from the description herein. Control functions described hereinafter are in terms of logical 1 or logical 0 conditions, and the actual voltage, phase or other distinguishing characteristic of a signal actually assigned to each logical value is merely a matter of design choice for a particular implementation. Also, while particular combinations of logic gates are shown, it will be appreciated that substantially similar operations can be achieved with alternate design alternatives, as is generally known in the art.

In FIG. 4, defrost pressure sensor 61, heat reclaim subcooling sensor 64, evaporator subcooling sensor **54*a*, differential pressure sensor 55*a* and high pressure limit switch 70, all of which are shown in FIG. 1, are repeated in FIG. 4 for purposes of clarity of explanation. AND gate 66, which receives leads or control lines 65 and 67 as shown in FIG. 1, is repeated in FIG. 4** also.

AND gate 101 is connected to receive an input from defrost pressure sensor 61 and a lead 102 from the defrost control logic which is explained hereinafter. OR gate 103 receives inputs from sensors **54*a* and 55*a*. If a plurality of subcooling and differential pressure sensors 54 and 55 are used for the system as explained above, all such sensors are combined by ORing their outputs at gate 103**.

AND gate 104 receives as an input the output of AND 101, via lead 106, a branch of which also leads to the defrost control logic explained hereinafter. The other input to AND 104 is provided by lead 105, which originates in the defrost control logic. Lead 105 is also applied through an inverter 107 to AND gate 109, which also receives the output of OR 103.

The outputs of AND gates 104, 66 and 109 are applied as inputs to OR gate 110. The output of OR 110 is connected as an input to AND 111. The other input to AND 111 is from a branch of lead 112, which connects from high pressure limit switch 70. The output of AND 111 connects via lead 130 to the input of an inverter 113, whose output connects via lead 115 to one input of NOR gate 117. Another inverter 114 is provided, and is connected to receive lead 112 and to provide its output connected via lead 116 to the other input of NOR 117.

NOR gate 117 is used to control heat motor 118, which in turn is connected to control valve 30 of FIG. 1. Heat motor 118 comprises an electrical heating element in an insulated housing with a bulb containing a fluid charge, as explained more fully in our co-pending application identified above. Heat provided by the electrical heating element establishes a pressure within the bulb, which is then connected as the reference pressure for the operation of control valve 30 in its control of condenser bypass. As explained in our co-pending application, when it is necessary to raise system head pressure, electrical power is applied to heat motor 118 which in turn raises the reference pressure for control valve 30, which then increases the amount of condenser bypass, thus flooding the condenser and raising the condensing temperature and pressure. In FIG. 4, an amplifier 119 is provided between NOR 117 and heat motor 118 in order to provide sufficient power output to drive the heat motor. It will be appreciated of course, that in the case of a relay implementation, the control signals themselves may have sufficient power to operate heat motor 118, and accordingly amplifier 119 would not be required.

The output of AND gate 111 is also used to drive a thermal time delay sequencer 120. This device includes a heating element 123, a first set of electrical contacts 121, and a second set of electrical contacts 122. Additional sets of electrical contacts may be provided and used to control varying numbers of condenser fans. Sequencer 120 operates to successively close the electrical contacts in response to accumulated temperature build-up as provided by the heating element, and to sequentially open the contacts in reverse order to their closing, upon cooling off of the sequencer when heating element 123 is de-energized, or is only infrequently energized. One commercially available device which may be used for thermal time delay sequencer 120 is model R8330, made by Honeywell, Inc., of Minneapolis, Minnesota.

A suitable voltage representing a logical 1 is applied to both contacts 121 and 122. The other contact of first contact pair 121 is connected to the input of an inverter 125. In like fashion, the other contact of second contact pair 122 connects to inverter 126. An amplifier 124 may optionally be provided between lead 130 and sequencer 120 for operating the heating element, if necessary, depending upon the power requirements of the device and the logic elements used.

The output of inverter 126 connects to AND gates 131 and 132. The output of AND 131 is applied as an input to OR gate 133, whose other input is connected to receive the output of inverter 125. The output of OR 133 is connected to one input of OR gate 135.

AND gate 132 receives one input from the output of inverter 126. A branch of lead 115 supplies inputs to gates 131 and 132. The output of AND 132 connects as an input to OR gate 136. A branch of lead 116 connects as the second input to OR gates 135 and 136.

The outputs of OR gates 135 and 136 are connected, for controlling the operation of condenser fans **26*a*, 26*b* and 26*c*. The embodiment shown uses three fans, with fans 26*b* and 26*c* being jointly controlled while fan 26*a* is controlled separately. A greater or lesser number of fans can be used, depending upon the requirements of the condenser. While two channels of fan control are shown, more or fewer can be used by expanding or simplifying the control logic. Also, it may be desirable to leave one fan on at all times and control the others. Suitable control devices 137 and 138** may be provided as is generally known in the art. These control devices may be solid state or relay power switches for electric motors which operate the fans.

Description of the Operation of FIG. 4

The operation of the control diagram of FIG. 4 will now be explained. It will be appreciated that OR gate 110 is a combination point for 3 different branches of control. Control signals from gate 104 represent a defrost pressure requirement; signals from gate 66 represent a reclaim pressure requirement; and signals from gate 109 represent subcooling, or differential pressure requirements for the evaporator loads.

In the embodiment of FIG. 4, differential pressure sensor 55a is designed to provide a logical 0 when the sensed pressure is high enough for proper operation of the evaporator expansion device, and to provide a logical 1 when the pressure drops below this level. One type of suitable differential pressure sensor 55a is shown in our above mentioned co-pending patent application, but it will be appreciated that other types of pressure sensors can be used. It will also be apparent to those skilled in the art that by proper design selection of springs and other components, the switching pressure can be selected as required for a given application.

Subcooling sensor 54a is designed to provide logical 0 output when the refrigerant in the liquid line is satisfactorily subcooled, and to provide a logical 1 if saturation is approached. It will be understood that how close the control switches before saturation may be varied to suit specific control designs or sensor locations. While the preferred embodiment senses subcooling and approach to saturation, other types of sensors could be used to switch at or near saturation.

Reclaim subcooling sensor 64 is designed to provide a logical 0 for subcooling, and a logical 1 when saturation is approached. Defrost pressure sensor 61 is used in the case of gas defrost, and provides a logical 0 when the predetermined high pressure for defrost is achieved, and a logical 1 when the pressure is below the preselected value for defrost. High pressure limit switch 70 provides a logical 1 for acceptable pressures, and a logical 0 if system pressure exceeds a preselected safety value.

If, at a given moment, system head pressure is high enough for all requirements, logical 0s are applied as the inputs to gate 110. Assuming that the high pressure limit as sensed by switch 70 is not exceeded, a 0 will appear at lead 130 at the output of AND 111. This will apply a 1 to lead 115, and a 0 at the output of NOR 117, and consequently heat motor 118 will not be energized.

At the same time, assuming that heating element 123 of sequencer 120 has not recently been energized, both contacts 121 and 122 will be open, and a logical 1 will be applied by inverters 125 and 126 through the fan control logic, and all fans will be operative.

If for any reason, one or more of the control modes calls for higher head pressure, appropriate signals will be generated to deactivate the condenser fans; to energize heat motor 118 to increase condenser flooding; and to energize heating element 123, which tends toward the ultimate effect of turning off fan 26a, as explained below.

The operation of the high limit logic is as follows: During normal operation, the high pressure limit will normally not be exceeded, but during a malfunction such as a heat reclaim blower failure; loss of refrigerant charge; or failures of sensors or logic gates which produce a continuous logic 1 at the output of OR 110, if the pressure exceeds a predetermined level, a 0 is provided at lead 112. This logical 0 inhibits gate 111, thus blocking any signals from gate 110 requesting higher pressure. At the same time a 0 on lead 112 provides a 0 at the output of NOR 117 to shut off heat motor 118, and a 1 is provided to OR gates 135 and 136 to start all condenser fans.

During normal operation, if defrost, reclaim, or evaporator subcooling or differential pressure considerations call for an increase in pressure, a logical 1 is applied to the appropriate input of OR gate 110. In the case of sensors 54a or 55a, subcooling near saturation or minimum pressure differential appears as a 1 at the input to gate 109. Unless gate 109 is inhibited during defrost conditions by a 0 at the output of inverter 107, this logical 1 will be transmitted to gate 110. In the case of reclaim subcooling near saturation as sensed by sensor 64, a logical 1 will be applied to gate 66. If heat reclaim has been selected for the particular subsystem involved, a logical 1 will be provided at lead 67 from the temperature proportional sequencer 80 of FIG. 2. In that case the logical 1 is transmitted through to gate 110; otherwise gate 66 is inhibited. In the case of defrost, higher pressure requirements for gas defrost are transmitted from sensor 61. If electric or off-cycle air defrost is involved in the particular defrost cycle, gate 101 is inhibited by control lead 102, and no additional pressure requirement is transmitted to gate 110. When the defrost initiate signal is received on lead 105, gate 104 is enabled to transmit the pressure requirement, if any, to gate 110. The manner in which head pressure is increased in response to a logical 1 at OR gate 110 will now be explained. Assuming that a high pressure limit over-ride condition as described above is not occurring, a logical 1 will appear at lead 112, so a 1 output of gate 110 will be gated through AND 111 to lead 130. The control system of FIG. 4 provides short term head pressure correction, and long term control. It will be appreciated that the most immediate control for head pressure is achieved through the condenser fans. Turning off one or more fans causes a very rapid increase in the temperature differential of the condenser, and a corresponding rise in condensing temperature and pressure. On the other hand, control of valve 30 to increase condenser flooding takes place at a slower rate, because it depends upon the rate of mass flow of refrigerant from the receiver through the evaporator loads and back to the condenser, and of course this is a function of the pumping rate of the compressors.

Condensers of the type used in large refrigeration systems usually require fans. The electrical energy required to operate the fans is a significant portion of the total system energy requirement, for example 5 to 10%. Accordingly, it is desirable to shut off fans to increase head pressure, and for mild outdoor temperatures limited amounts of head pressure increase are possible by fan control only. However, more severe ambient temperatures require both fan control and condenser flooding.

When a requirement exists for increasing the head pressure, and cc ısequently the condensing temperature difference, a logical 1 appears at lead 130. This logical 1 has the effect of energizing heat motor 118 and heating element 123, and immediately turning off condenser fans 26b and 26c, by removing an enabling signal from gate 132. Condenser fan 26a remains on (assuming that contact 121 is open) because of a logical 1 applied through gate 133.

The system response to turning off two of the fans will typically be a rapid rise in head pressure which will overshoot the requirement of the sensor originally calling for the increase. When the sensor calling for the increase is satisfied the logical 1 is removed from lead 130, fans 26b and 26c are turned on again, and heat motor 118 and the heater in sequencer 120 are de-energized. As the head pressure drops again, the cycle may be repeated. During the time that a 1 appears at lead 130, devices 118 and 120 are accumulating heat, and during the time that a logical 0 appears at lead 130, the devices are cooling. Thus, the ratio of the average time durations of 1's to 0's at lead 130 becomes the key to understanding the operation of the pressure control system. Both devices 118 and 120 gain heat faster than they lose it. The cooling rate of sequencer 120 is relatively constant, since it is physically located with the control system in the comfort conditioned space in the building. However, the cooling rate of heat motor 118 varies greatly depending upon the outdoor ambient, since it is mounted outdoors and is subject to the same ambient temperature as the condenser.

For small required increases in head pressure, as may be required by subcooling or differential pressure sensors 54a and 55a during normal refrigeration operation, the cycling of fans 26b and 26c may be enough, in which case no significant heat builds up in heat motor 118, because of the relatively low average duration of 1's at lead 130.

However, if turning off fans 26b and 26c is not enough to raise the head pressure, or if relatively long off cycles of the fans are required, then the eventual heat build up in heat motor 118 will raise the head pressure by controlling condenser flooding.

In response to a requirement for a large pressure increase and corresponding large condensing temperature difference, which might occur for example upon switching to gas defrost mode, the system operates as follows. A 1 at lead 130 causes an initial turning off of fans 26b and 26c, but this may not be enough to sufficiently raise the pressure. Alternatively, cycling of fans off and on will maintain the desired pressure, but with a high ratio of average duration of 1's to 0's at lead 130. In either case, heat will accumulate in both heat motor 118 and sequencer 120. Since heat motor 118 is exposed to a higher temperature difference due to its outdoor location, its heat loss rate may be high. Therefore, in this example, before heat motor 118 reaches the necessary temperature to fully control head pressure by condenser flooding, sequencer 120 builds up sufficient temperature to close contact 121. This removes the logical 1 supplied to gate 133 by inverter 125, and fan 26a is shut off, or is allowed to cycle with the other fans in response to 1's and 0's at lead 130. If the temperature in sequencer 120 builds up higher, contact 122 may close also. This would inhibit both gates 131 and 132 and all fans would be turned off.

As the temperature in heat motor 118 approaches that required for head pressure control by flooding, the 1's ratio at lead 130 decreases and equilibrium is eventually reached within heat motor 118. The fans may or may not come back on. The 1's ratio at lead 130 and the energy input to heat motor 118 to maintain equilibrium is a function of the condensing temperature difference. For a high condensing temperature difference, for example on a cold day, the 1's ratio required for energization of heat motor 118 may be high enough that sequencer 120 closes both contacts 121 and 122, thus locking all fans off. For a more moderate condensing temperature difference, for example on a day with a more moderate temperature, not as high a 1's ratio is required for equilibrium of heat motor 118, and one or all of the fans may be allowed to cycle with 1's at lead 130, depending upon whether the average heat input to sequencer 120 (as determined by the 1's ratio) is enough to maintain one or both of contacts 121 and 122 closed.

If heat reclaim mode is selected, most of the condensing takes place in the reclaim coil which is in series with, and upstream of the condenser. Since little or no condensing takes place in the condenser, turning off the fans will have little effect upon head pressure. In that case, the time duration of logical 1's at lead 130 will be very high in order to drive heat motor 118 to raise the head pressure by flooding, and consequently sequencer 120 will build up enough heat to eventually turn all fans off. This is of course the desired result, since the running of the fans when the condenser is not effective does not perform any useful function, and absorbs excessive power.

At any time to reduce head pressure, a 0 at lead 130 removes the energization to heat motor 118 and sequencer 120, and possibly turns fans on, depending on the state of sequencer 120, and head pressure eventually drops to the desired lower value.

The over-all effect of the head pressure control logic is to provide immediate response for requests for increased pressure by cycling of one or more fans, plus long term response in terms of increased condenser flooding and a decrease in the number of fans that are cycling. It will be appreciated that other types of controls for the fans and the head control valve can be provided for achieving substantially the same response to requirements according to the present invention.

In order to achieve the pressure control of the present invention for minimum pressure required by a hierarchy of modes at a given moment, it is necessary to interface the control system of FIG. 4 or its equivalent with evaporator load defrosting techniques. A number of such techniques are used in common commercial practice, depending upon the type of load. For example, some evaporator loads are designed to operate with hot gas defrosting, and others with cool (saturated) gas defrost. Still others use electric heating elements for defrosting, and others use off cycle air blowing over the evaporator coils for defrosting. It will be appreciated that in a typical installation such as in a supermarket, more than one of the above types of defrost may be used. It will also be appreciated that some or all of these loads may be operated by clock devices which are preprogrammed to given defrost schedules. Other loads may use demand defrost, where various types of demand sensors as are generally known in the art may be provided for initiating defrost cycles when a predetermined amount of frost has built up.

In order to accommodate these diverse and at times conflicting types of defrost while still maintaining minimum head pressure under the circumstances, defrost logic circuits of FIGS. 5 and 6 may be provided. FIG. 5 is a simplified plan for use when all loads use clock scheduled defrosting system using any type of defrosting. FIG. 6 is a more general plan using either clock or demand defrosting control using any type of defrosting.

Considering first FIG. 5, reference numbers 150, 151 and 152 refer to clocks or timers which may be set or programmed to initiate and terminate defrost cycles as is generally known in the prior art. In the embodiment shown, clock 150 is connected for controlling electric defrosting; clock 151 is connected for gas defrosting, and clock 152 is connected for controlling off cycle defrosting. It will be appreciated from the description which follows that some of these could be deleted for a given application, and that multiple clocks would be provided for defrosting of multiple loads, by simple expansion of the logic of FIG. 5.

The output of clock 150 connects via lead 153 to inputs of OR gate 155, NOR gate 156, and AND gate 157. The output of clock 151 connects via lead 154 to inputs of OR gate 155 and AND gate 158. The output of clock 152 connects via lead 155 to inputs of OR gate 155, NOR 156, and AND gate 159.

The output of OR gate 155 is the defrost initiate line 105, a branch of which connects to FIG. 4. Lead 105 also connects as inputs to a pair of AND gates 160 and 161. The other input to AND gate 160 comes from the output of an inverter 162. The input to inverter 162 is a branch of lead 106 from FIG. 4. The outputs of AND gates 160 and 161 are applied as inputs to OR gate 163. The output of gate 163 is applied via lead 164 to inputs to AND gates 161, 157, 158, 159, and NAND gate 165. The other input to NAND 165 is from lead 102 which connects from the output of NOR 156. A branch of lead 102 extends to FIG. 4 as indicated.

The output of gate 158 connects to control gas defrost reversing valve 45. It will be appreciated that a number of such gates, controlled by appropriate clocks, would be provided for controlling different gas defrost reversing valves for the various evaporator loads that are controlled thereby. In case of multiple loads of this type, it is of course preferable to program their defrosting clocks at different intervals so that not too many are put into defrost at once, as is generally known in the art.

The output of AND gate 157 is applied to an electric defrost heater 166 for an evaporator which uses that type of defrost. The signal is also applied to inverter 167, if necessary, to pump down valve **43*e*** for the corresponding evaporator, so as to shut off the flow of refrigerant during such time as the electric defrost heater is in operation.

The output of AND gate 159 connects to the pump down valve **43*o*, corresponding to the evaporator which is defrosted by that method. It will be appreciated that the two evaporator loads shown in FIG. 1** are merely representative of a number of loads connected in a typical system, and individual evaporator loads within the subsystem would be connected for defrosting according to the particular mode applicable to them.

In operation, activation of any of clocks 150–152 to initiate a defrost cycle applies a logical 1 through OR 155 to lead 105. This inhibits the subcooling sensor and differential pressure sensors for the affected load, by applying a 0 to gate 109 of FIG. 4. However, AND 160 will not be enabled until a 1 output is provided by inverter 162, which in turn depends upon receipt of a logical 0 at lead 106.

Gate 156 receives inputs only from the electric defrost clock 150 and the off-cycle defrost clock 152, but not from gas defrost clock 151. Thus, in case of activation of either clocks 150 or 152, in addition to providing a logical 1 at lead 105, a logical 0 will be provided at lead 102, which serves to inhibit gate 101 on FIG. 4. This has the effect of locking out defrost pressure sensor 61, since there is no need to increase system head pressure for either of these modes of defrost. A logical 0 at lead 106 thus acts through inverter 162 to enable gate 160.

On the other hand, if clock 151 had been the one which provided a logical 1 to gate 155 and lead 105, since it is not connected to gate 156, a logical 1 would have remained at lead 102, enabling gate 101. As long as the defrost pressure as sensed by sensor 61 is below the desired pressure for gas defrost, a 1 appears at its output, and a 1 appears at lead 106. As previously described, this logical 1 is passed through gates 104 and 110 to initiate an increase in pressure. However, as long as the pressure remains below defrosting pressure, the 1 on lead 106, as inverted by inverter 162 inhibits gate 160. Only after the pressure has been increased to the desired value does a 0 appear at the output of sensor 61, thus enabling gate 160 of FIG. 5. A logical 1 then passes to OR gate 163. The output at 164 latches via AND gate 161, so that as long as the defrost clock is at a logical 1, defrosting will continue, even though the pressure may momentarily drop below that required for sensor 61.

Once lead 164 is at a logical 1, gates 157–159 are enabled, and whichever of the clocks initiated the defrost will pass its 1 through its corresponding gate to operate reversing valve 45, defrost heating 166 and valve **43*e*, or off-cycle valve 43*o***, as the case may be.

At the same time that lead 164 goes to a logical 1, NAND 165 may de-energize valve 40 of FIG. 1, depending upon whether clock 151 was the clock which initiated the defrost cycle. If so, a 1 will be present at lead 102 also, and control valve 40 will be de-energized and closed to divert refrigerant through check valve 41 to establish the necessary pressure drop for gas defrost operation. For off cycle or electric defrost, gate 156 would provide a 0 output, and valve 40 would remain energized and open.

Demand defrost logic is shown in FIG. 6, for those evaporators which utilize initiation of defrost cycle by a demand sensor of some type as is generally known in the prior art. Reference numbers 170, 171 and 172 refer to three such demand sensors. If both clock scheduled and demand controlled defrost are used in the same system, the embodiment of FIG. 6 should be used, and defrost clocks can be connected into the system in place of a sensor 170–172. The clock then becomes the "demand" for starting a defrost cycle. Sensor 170 connects via lead 173 to AND gate 176, and to AND gate **158*a*. Defrost sensor 171 connects via lead 174 to AND gate 177, AND gate 157*a*, and NOR gate 156*a*. Defrost sensor 172 connects via lead 175 to AND gate 178, AND gate 159*a*, and NOR gate 156*a*. For illustrative purposes, one of each of the three defrost methods is shown, but it will be appreciated that any number of separate demand sensors and appropriate outputs can be provided by expanding FIG. 6**.

For illustrative purposes in FIG. 6, sensor 170 is for gas defrost, sensor 171 is for electric defrost, and sensor 172 is for off-cycle defrost. These three sensors are connected to gates **157*a*, 158*a* and 159*a* which correspond and function to gates 157–159 of FIG. 5**.

Since the defrost cycles are not necessarily under clock control but instead may operate by demand in FIG. 6, a scanner is used to select defrost loads so as to preclude the possibility that too many evaporators would be defrosting at once, upsetting system operation. This is accomplished in the embodiment of FIG. 6 through the use of sequencer 180 and associated logic, but it will be appreciated that other types of logic could be used for blocking out or delaying a certain number of defrost cycles while others are in operation. In FIG. 6, sequencer 80 is an electronic or electromechanical stepping device which is driven by driver 181. Upon energization of driver 181, logical 1's appear sequentially at output leads 182–185 of sequencer 180. The first three of these output leads connect respectively to AND gates 176, 177 and 178. Output 185 connects through delay device 186, whose output connects to AND gate 187. The output of AND gate 187 connects to driver 181. The outputs of gates 176–178 are connected as inputs to NOR gate 188, the output of which connects via lead 189 to inverter 190, and to the other input of AND gate 187.

In the absence of the demand for defrost, a logical 1 at lead 189 enables gate 187. Driver 181 is then energized and sequencer 180 cycles through outputs 182 through 185. At output 185, delay 186 is energized which removes the logical 1 from lead gate for a predetermined period of time, then returns it, and the sequence is repeated. Delay 186 is used to slow down a mechanical scanner for a longer service life, but of course in the case of an electronic scanner it would not be needed.

During a scan by sequencer 180, gates 176–178 are sequentially enabled. If a demand signal is being supplied by any of sensors 170–172, the demand signal will be gated through the corresponding AND gate to NOR 188. This will remove the drive to the sequencer and temporarily lock the sequencer in the position to enable the sensor which initiated the demand. At the same time the logical 0 at lead 189 is inverted at gate 190 and applied as the defrost initiate signal at lead **105*a***.

The circuitry and function of the portion of the logic involving gate **160*a* through 165*a*, and also gate 156*a*, are identical to their correspondingly numbered parts in FIG. 5. Upon a defrost initiate, subcooling sensor 54*a* and pressure differential sensor 55*a* of FIG. 4 are inhibited, and gate 160*a* is enabled immediately, in the case of electric or off-cycle defrost, or after the build up of system head pressure, in the case of gas defrost. Once gate 163*a* is enabled, it is latched on by gate 161*a*, and gates 157*a*–159*a* are enabled so that the demand sensor initiating the cycle can activate its appropriate defrosting apparatus. At the same time, solenoid valve 40*a* is de-energized and closed to divert flow through check valve 41**, if a gas defrost cycle is involved.

At the end of the defrost cycle, the demand sensor changes its state, the defrosting apparatus returns to normal operation, the defrost initiate signal at lead **105*a*** returns to logical 0, and the scanning sequence resumes.

As set forth in the foregoing description, we have provided an improved control system for a refrigeration system employing heat reclaim. The system achieves optimum efficiency by controlling head pressure according to the minimum requirement of a number of modes including normal refrigeration, heat reclaim and defrost. A higher pressure mode overrides lower pressure modes, but only during the time that the higher mode is active, so that control is always with reference to the lowest pressure active mode. Successive stages of heat reclaim are activates in response to demand, with individual subsystems in a multiple system being sequentially brought up to full condensing in the reclaim coil. The control system can accommodate all types of evaporator load defrosting, and both clock and demand control thereof.

What is claimed is:

1. A control system for a refrigeration system capable of different modes of operation, comprising:

(a) a plurality of sensing means operative for sensing conditions of the refrigeration system operation which are indicative of operation thereof in each of said modes;

(b) head control means operatively connected for controlling condensing temperature and pressure of the refrigeration system; and (c) control means connected to said sensing means and to said head control means and operative to maintain refrigeration system pressure substantially at the optimum pressure requirement for the active mode having the highest pressure requirement.

2. A control system for a refrigeration system having a heat reclaim coil, comprising:

(a) sensing means for sensing subcooling in the liquid line at a point which will ensure at least minimum subcooling at the expansion devices of the evaporators;

(b) means for sensing the differential pressure across at least one of the evaporator expansion devices;

(c) means for sensing subcooling at the outlet of the heat reclaim coil;

(d) head control means operatively connected to control condensing pressure and temperature of the refrigeration system; and (e) control means for connecting said sensing means to said heat control means and operative in a first mode to maintain head pressure high enough to maintain subcooling and pressure differential at the expansion devices above predetermined minimum values, and operative in another mode in response to a demand for heat reclaim to maintain head pressure high enough to maintain substantially full condensation of refrigerant in the heat reclaim coil.

3. A control system according to claim 2 including a defrost pressure sensor for comparing system head pressure to a predetermined defrost value, and wherein said control means is operative in a third mode for elevating head pressure to said predetermined defrost pressure, in response to a requirement for evaporator defrosting.

4. A control system according to claim 3 including means for preventing said defrost pressure sensor from controlling said control means in case of non-gas evaporator defrosting.

5. A control system according to claim 2 wherein said head control means includes a condenser bypass control valve for controlling condenser flooding, and means for controlling condenser fan operation.

6. A control system for a multiple refrigeration system which includes a plurality of refrigeration systems having heat reclaim coils and diverter valves for selectively diverting refrigerant therethrough, comprising:

(a) means for sensing reclaim heating requirements;

(b) means for operating at least one of said diverter valves to direct refrigerant through said reclaim coils in response to a first level of heating requirement; and (c) means for increasing head pressure in at least one of said subsystems to maintain substantially full condensation in its associated reclaim coil in response to another level of heating requirement.

7. A control system according to claim 6 wherein said means for increasing head pressure comprises means for sequentially increasing head pressure to maintain substantially full condensation in the reclaim coils of successive refrigeration subsystems in response to further levels of heating requirement.

8. A method of controlling a refrigeration system capable of different modes of operation, comprising the steps of:

(a) sensing a plurality of conditions of the refrigeration system which are indicative of the operation thereof in each of said modes; and (b) controlling condensing temperature and pressure of the refrigeration system in response to the sensed conditions to maintain system head pressure substantially at the optimum pressure required for the active mode having the highest pressure requirement.

9. A method of controlling head pressure in a refrigeration system having a heat reclaim coil, comprising the steps of:

(a) sensing subcooling in the liquid line at a point which will ensure at least minimum subcooling at the expansion devices of the evaporators;

(b) sensing the differential pressure across at least one of the evaporator expansion devices;

(c) sensing subcooling at the outlet of the heat reclaim coil;

(d) controlling system head pressure in a first mode to maintain head pressure high enough to maintain subcooling and pressure differential at the expansion devices above predetermined minimum values; and (e) controlling system head pressure in another mode in response to a demand for heat reclaim to maintain head pressure high enough to maintain substantially full condensation of refrigerant in the heat reclaim coil.

10. A method of control according to claim 9 including the further steps of comparing system head pressure to a predetermined pressure for gas defrosting, and controlling system head pressure to elevate the pressure to said predetermined defrost pressure in response to a requirement for evaporator defrosting.

11. The method of claim 9 wherein said steps of controlling head pressure include controlling condenser flooding and condenser fan operation.

12. A method of controlling heat reclaim in a multiple refrigeration system which includes a plurality of refrigeration systems having heat reclaim coils, comprising the steps of:

(a) sensing reclaim heating requirements;

(b) diverting refrigerant through at least one of said reclaim coils in response to a first level of heating requirement; and (c) increasing head pressure in at least one of said systems to maintain substantially full condensation in its associated reclaim coil in response to another level of heating requirement.

13. The method according to claim 12 wherein said step of increasing head pressure comprises sequentially increasing the head pressure of successive systems of said multiple refrigeration system to maintain substantially full condensation in the reclaim coils thereof in response to successive levels of heating requirement.

* * * * *